US007980380B2

(12) United States Patent
Thielmann

(10) Patent No.: US 7,980,380 B2
(45) **Date of Patent: *Jul. 19, 2011**

(54) BEVERAGE BOTTLING PLANT FOR FILLING BOTTLES WITH A LIQUID BEVERAGE MATERIAL HAVING BOTTLE PLATE SUPPORT TABLES THEREIN

(75) Inventor: Heinz Thielmann, Dortmund (DE)

(73) Assignee: KHS GmbH, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/706,185

(22) Filed: Feb. 16, 2010

(65) Prior Publication Data

US 2010/0140049 A1 Jun. 10, 2010

Related U.S. Application Data

(63) Continuation of application No. 11/271,166, filed on Nov. 12, 2005, now Pat. No. 7,673,435.

(30) Foreign Application Priority Data

Nov. 12, 2004 (DE) ..... 10 2004 054 891

(51) Int. Cl.
*B65B 17/00* (2006.01)

(52) U.S. Cl. ..... 198/377.01; 198/803.11; 198/867.12; 198/473.1; 198/394; 53/167; 53/135.1; 53/253; 53/317; 53/331.5

(58) Field of Classification Search ..... 198/473.1, 198/803.11, 465.2, 867.01, 377.01, 377.05, 198/377.1, 394; 53/253, 331.5, 317, 319, 53/167, 135.1; 156/567, DIG. 26, DIG. 27
See application file for complete search history.

(56) References Cited

U.S. PATENT DOCUMENTS

| | | | | |
|---|---|---|---|---|
| 7,572,123 | B2 * | 8/2009 | Barker et al. | 425/392 |
| 7,673,435 | B2 * | 3/2010 | Thielmann | 53/167 |
| 7,708,136 | B2 * | 5/2010 | Uriel | 198/803.11 |

* cited by examiner

*Primary Examiner* — Mark A Deuble
(74) *Attorney, Agent, or Firm* — Nils H. Ljungman & Associates

(57) ABSTRACT

A beverage bottling plant for filling bottles with a liquid beverage material having bottle plate support tables therein. The abstract of the disclosure is submitted herewith as required by 37 C.F.R. §1.72(*b*). As stated in 37 C.F.R. §1.72 (*b*): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 16 Drawing Sheets

BEVERAGE BOTTLING PLANT FOR FILLING BOTTLES WITH A LIQUID BEVERAGE MATERIAL HAVING BOTTLE PLATE SUPPORT TABLES THEREIN

CONTINUING APPLICATION DATA

This application is a continuation application of U.S. patent application Ser. No. 11/271,166, filed on Nov. 12, 2005, which claims priority from Federal Republic of Germany Patent Application No. 10 2004 054 891.9, filed on Nov. 12, 2004. U.S. patent application Ser. No. 11/271,166 was pending as of the filing date of this application.

BACKGROUND

1. Technical Field

The present application relates to a beverage bottling plant for filling bottles with a liquid beverage material having bottle or container plate support tables or bottle or container carriers therein.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Bottle plates with a friction lining as the support surface for bottles or similar containers and optionally with a centering surface for the centering of the bottle or of the container on the bottle plate are used in bottle or container handling machines, and also in particular in labeling machines. Especially in labeling machines, the bottle plates are each fastened to a respective rotation device, which for its part is provided on a turntable or rotor that can be driven so that it rotates around a vertical machine axis and so that the bottles that are standing upright with their base on the respective bottle plate, when the turntable is rotated by means of the rotation device, the individual bottles are subjected to a controlled rotation around their vertical axis by means of the rotation device and the respective bottle plate, and specifically, among other things, for the transfer, the application and brushing-on of the respective label. To achieve a reliable rotation of the bottles and thus a correct labeling, especially at high throughputs of the labeling machine, it is necessary to replace worn friction linings that can no longer guarantee a correct co-rotation of the respective bottle.

If the bottle plates are provided on their top side with a centering surface that centers the bottles in the vicinity of their base, and if the centering surface is adapted to the shape and/or the diameter of the bottles in the vicinity of the base of the bottle, when the labeling machine is converted from one type of bottle to another type of bottle it is also necessary to replace the bottle carriers with said centering surfaces, which is just as time-consuming and expensive a process as the exchange or replacement of the friction linings.

OBJECT OR OBJECTS

The object is to indicate a bottle plate that eliminates these disadvantages and makes possible a fast and easy replacement of the respective friction lining and/or of the centering element. The present application teaches that this object can be accomplished by a bottle plate as disclosed hereinbelow.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail below with reference to the exemplary embodiments illustrated in the accompanying figures.

DESCRIPTION OF EMBODIMENT OR EMBODIMENTS

Figure 1:
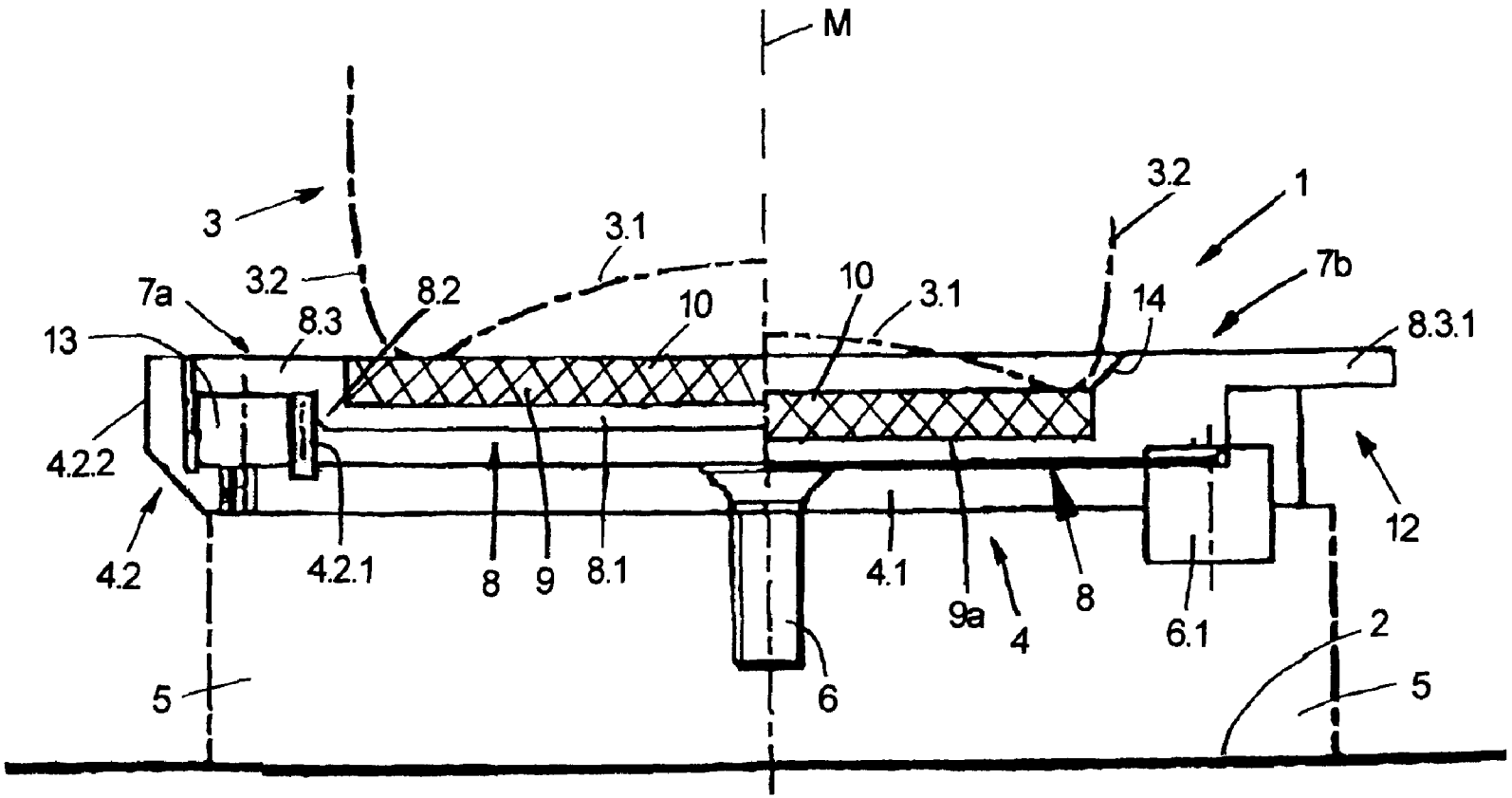
FIG. 1 is a simplified section through a two-part bottle plate in two different exemplary embodiments.
Figure 1A:
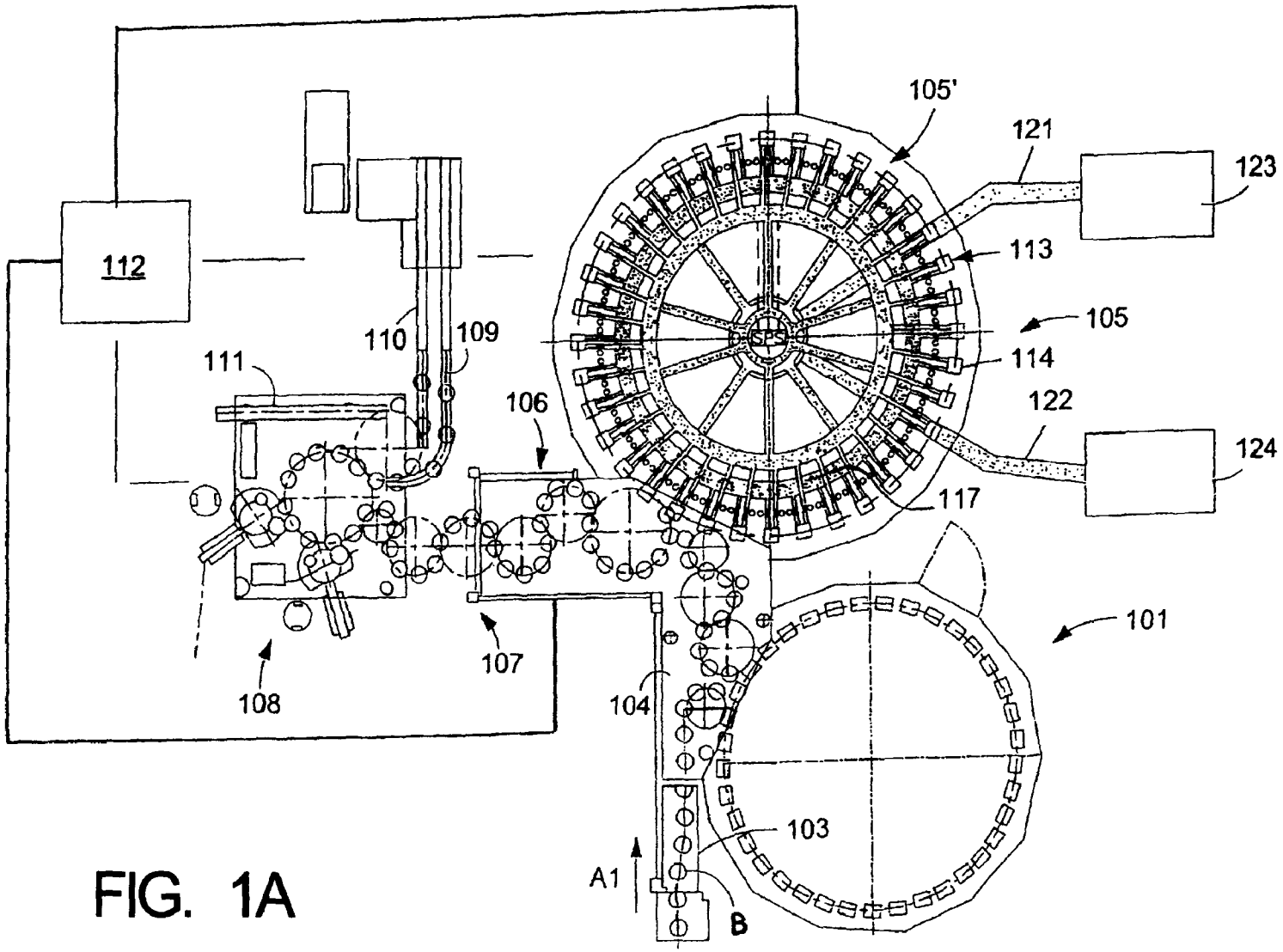
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The bottle plate or container plate support table which is designated 1 in general and is illustrated in FIG. 1 is a component of a labeling machine of which, in FIG. 1, the item designated 2 is only a very schematic illustration of a rotor or turntable that can be driven in rotation around a vertical machine axis, and like the rest of the plurality of additional container plate support tables 1 provided on the rotor 2 forms the support surface for the bottoms 3.1 of the upright bottles 3 that have been or will be labeled.

In this exemplary embodiment, the container plate support table 1 is realized in two parts, i.e. it comprises a bottle plate bottom part 4 which is fastened to the upper side of a rotation device 5 which is provided separately on the rotor 2 for each container plate support table 1, and specifically by means of a screw 6 which is provided centrally on the bottle plate part bottom part 4 coaxially with the vertical center axis M of the essentially circular bottle plate 4. The rotation device can be rotated by the cam control system or a servo-drive around the axis M synchronously with the rotation movement of the turntable 2.

The accurate centering of the container plate support table 1 on the rotation device 5 is accomplished by means of a lug 6.1 which is provided on the upper side of the rotation device 5 and is engaged in a corresponding boring of the bottle carrier bottom part 4.

The bottle plate bottom part 4 is realized on its upper side facing away from the rotation device 5 with a depression, and specifically with a base 4.1 that is in contact against the upper side of the rotation device 5, and with an essentially ring-shaped edge 4.2 that projects beyond the side of the base 4.1 that faces away from the rotation device 5. The peripheral area 4.2 is realized in a stepped or graduated shape, i.e. it comprises an inner, ring-shaped segment 4.2.1 which concentrically encircles the center axis M, and an outer, likewise ring-shaped segment 4.2.2 which projects in the direction of the center axis M somewhat beyond the upper side of the segment 4.2.1.

The bottle plate or container plate support table 1 also comprises a bottle plate top part which is held non-rotationally, but which can also be easily removed from the bottle plate bottom part 4.

FIG. 1 shows, on the left, a bottle plate top part 7*a*, which comprises an essentially disc-shaped plate element 8 which is manufactured from a ferromagnetic material, for example of stainless steel. In the center, the plate element 8 is provided with a circular depression 9, so that it has a base 8.1, an edge 8.2. that projects beyond the base and a ring-shaped flange 8.3 that projects radially beyond the edge 8.2 and lies in a plane parallel to the plane of the base 8.1. In the recess 9 there is a friction lining 10, which can be fastened in place by adhesive, for example, and which then forms the actual support surface for the base 3.1 of the respective bottle 3 and is realized in a laminated structure, for example, with a bottom ply that is made of a fabric and with a ply on top of that made of a wear-resistant material with a sufficiently high coefficient of friction, for example rubber or a synthetic resin material and with a textured upper side which in the exemplary embodiment illustrated is in contact with the upper side of the flange 8.3.

Figure 2:
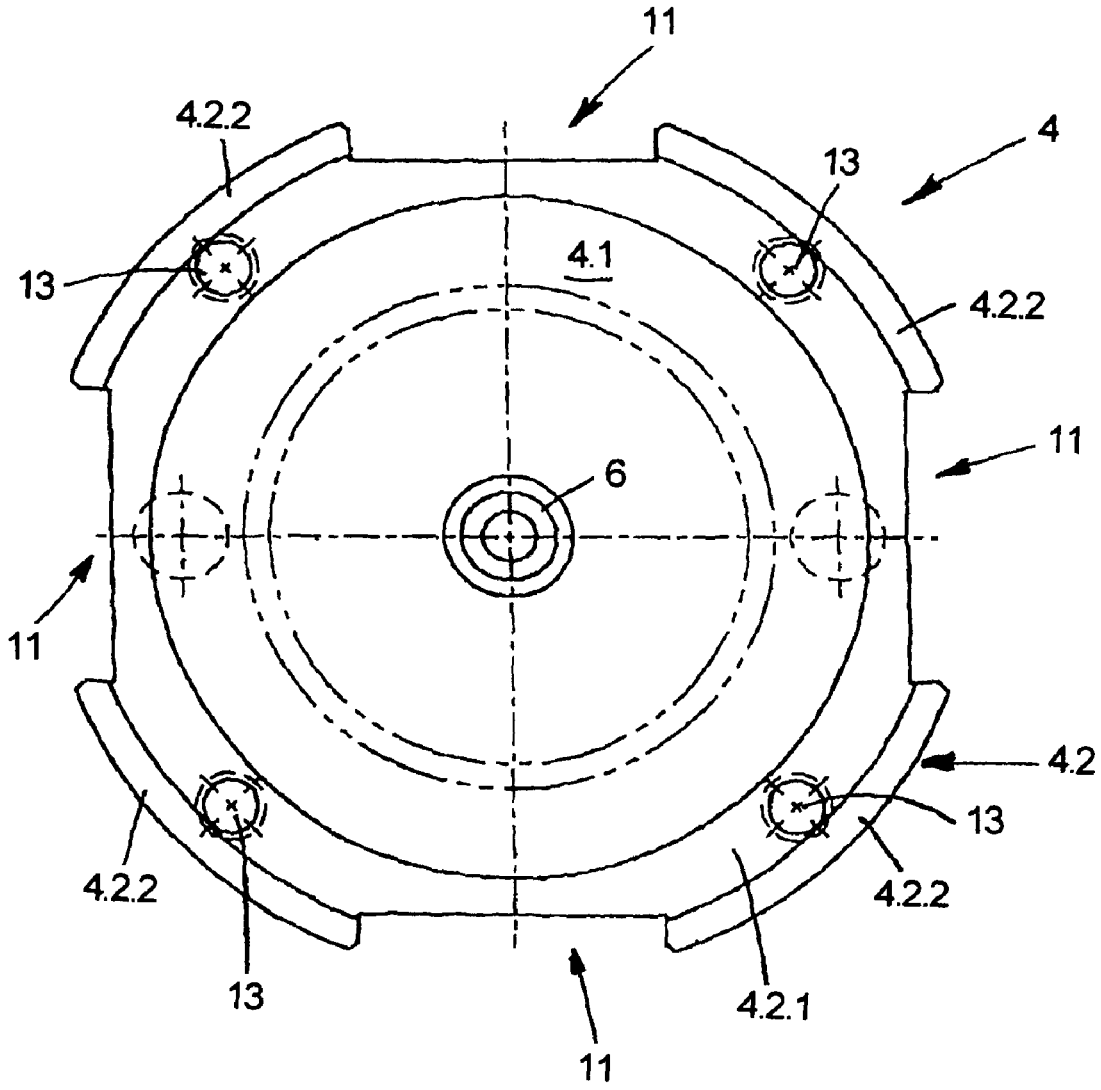
FIGS. 2 and 3 are simplified plan views of the lower part of the bottle plate (bottle plate bottom part) and the upper, interchangeable or replaceable part of the bottle plate (bottle plate top part) in FIG. 1.

The flange 8.3 is realized with a plurality of radially projecting tab-like or flap-like extensions 8.3.1, which in one illustrated exemplary embodiment are offset by 90 degrees around the center axis M and which, when the bottle plate top part 7*a* is placed on the bottle plate bottom part 4, are each received in a recess 11 in the segment 4.2.2 of the peripheral area 4.2 (FIG. 2), so that as a result, the bottle plate top part 7*a* is held non-rotationally on the bottle plate bottom part 4. The recesses 11 provided in the segment 4.2.2 are open toward the upper side of the bottle carrier top part 7*a* as well as radially outward and inward. In the vicinity of each recess 11, the bottle plate bottom part 4 is provided on its circumference with an additional notch 12.

When the bottle plate top part 7*a* is connected with the bottle plate bottom part 4, the plate element 8 is held with its depressed area in the depression of the bottle plate bottom part 4, and in particular so that it is in contact with the outer surface of the edge 8.2 against the annular surface formed by the segment 4.2.1, the flange 8.3 lies with its underside on the upper side of the segment 4.2.1, the flange 8.3 is encircled on the outside by the segment 4.2.2 and the extensions 8.3.1 held by the recesses 11 in the segment 4.2.2 each project slightly beyond the peripheral surface of the bottle plate bottom part 4 in the vicinity of the lateral recesses 12, so that the extensions 8.3.1 form easily accessible handle surfaces.

To also secure the bottle plate top part 7*a* against separation from the bottle plate bottom part 4 in the direction of the center axis M, but simultaneously to allow a rapid replacement of the bottle plate top part 7*a*, in segment 4.2.1 there are a plurality of permanent magnets 13 distributed around the center axis M which fix the bottle plate top part 7*a* on the flange 8.3 when it is inserted into the bottle plate bottom part 4.

The bottle plate top part 7*b* illustrated in FIG. 1 to the right of the center axis M differs from the bottle plate top part 7*a* only in that the recess 9*a* which corresponds to the recess 9 and is designed to hold the friction lining 10 is deeper than the recess 9, so that the friction lining 10 lies lower with its upper side than the upper side of the flange segment 8.3. At the transition between the upper side of the flange 8.3 and the upper side of the friction lining 10, there is a conical ring-shaped centering surface 14 that concentrically encircles the center axis M, and specifically at a conical angle which, in the illustration selected for FIG. 1, opens toward the top. The centering surface 14, as illustrated in FIG. 1 to the right of the center axis M, interacts with the respective bottle 3 at the transition between the bottle base 3.1 and the bottle peripheral wall 3.2, to also center the bottle 3 on the container plate support table 1.

The advantage of the container plate support table 1 is, among other things, that when the friction lining 10 becomes worn and/or when there is a reconfiguration or conversion of the bottle handling machine or labeling machine in question so that it can handle bottles 3 with a different diameter or a different shape, the current bottle plate top parts 7*a* or 7*b* can be replaced quickly and easily, i.e. in particular without requiring any tools, for bottle plate top parts, the friction lining of which is new and/or which, with regard to the size of the friction lining and/or the size of the support surface enclosed by the centering surface 14 are adapted to the size and shape bottles 3 to be processed after the reconfiguration.

Figure 4:
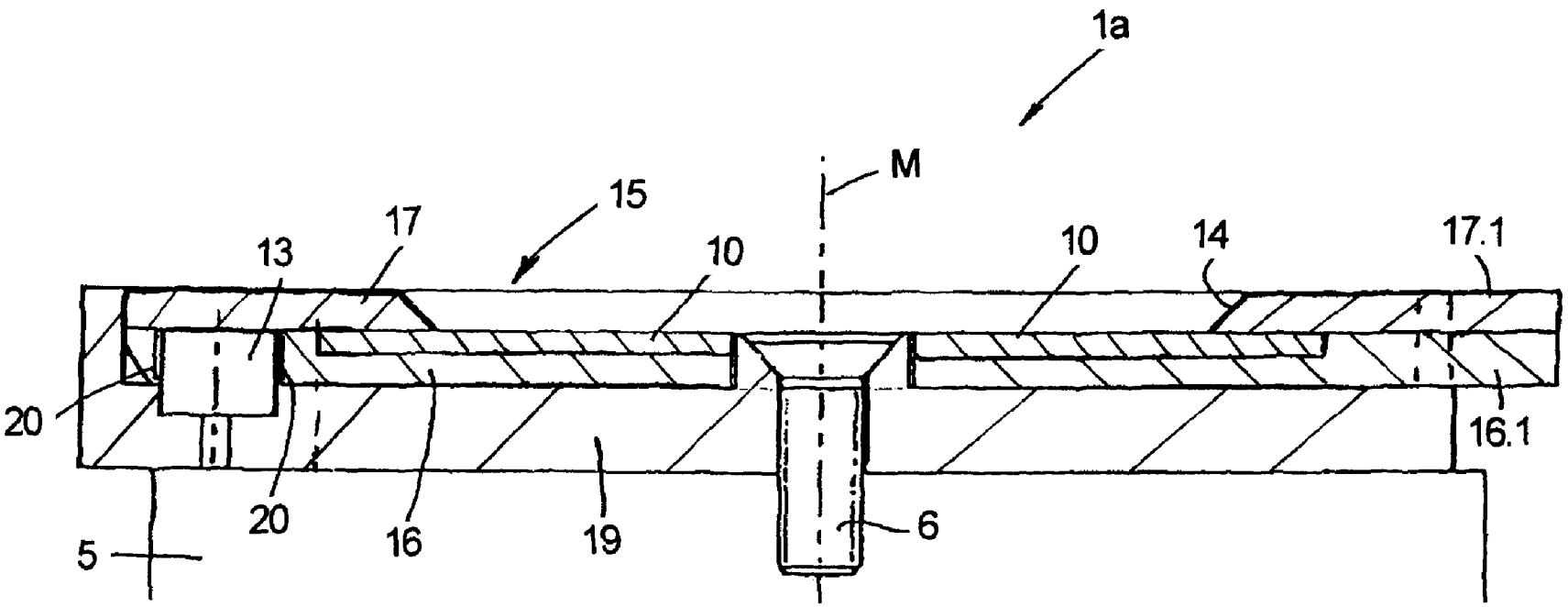

FIG. 4 shows a container plate support table 1*a* in an illustration similar to FIG. 1 as one additional possible exemplary embodiment. While in the exemplary embodiment illustrated on the right in FIG. 1 the bottle plate top part 7*b* is replaced in its entirety, i.e. with friction lining 10 and centering surface 14, it is possible on the container plate support table 1*a*, for a reconfiguration or conversion of the machine in question from one size and/or shape of bottle to another, to adapt only the centering surface 14, in terms of shape and size, and/or to replace only the friction lining when it becomes worn.

Figure 5:
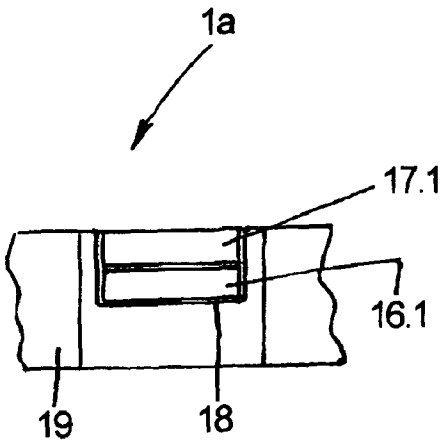
FIGS. 4 and 5 are simplified views in section through a three-piece bottle plate and a partial illustration and side view of said bottle plate.

For this purpose, the bottle plate top part 15 that corresponds to the bottle plate top part 7*b* is realized in two parts and comprises a bottom plate element 16 which in the illustrated exemplary embodiment is realized in the shape of a circular ring and has the friction lining 10, and a top plate element 17 which rests on the upper side of the plate element 16 and has the centering surface 14. These two plate elements 16 and 17, which are stacked one on top of the other, are in turn provided on the periphery with the flap-like or tab-like extensions 16.1 and 17.1 respectively which correspond to the extensions 8.3.1 and, when the container plate support table 1*a* is assembled, are engaged in corresponding recesses 18, which correspond to the recesses 11, on the edge of the bottle plate bottom part 19 that corresponds to the bottle plate bottom part 4 and is connected with the rotation device 5, and specifically so that an extension 17.1 is located by means of an extension 16.1 in each recess 18 (FIG. 5).

The securing of the two-part bottle plate top part 15 on the bottle plate bottom part 19 to prevent separation is in turn achieved by the permanent magnets 13, which are arranged in the bottle plate bottom part 19 so that each permanent magnet 13 extends through an opening 20 on the edge of the plate element 16 and interacts with the peripheral area of the overlying plate element 17 so that the two plate elements 16 and 17 are secured by the magnetic force to prevent unintentional separation, and the lower plate element 16 is also secured to prevent rotation by the permanent magnets 13 that extend through the openings 20. Basically, this realization also makes it possible to eliminate the extensions 16.1 on the plate element 16.

The advantage of the container plate support table 1*a* is that the two plate elements 16 and 17 can be replaced independently of each other, and specifically the bottom plate element 16 for the replacement of the friction lining 10 and the top plate element 17 to adapt the container plate support table 1*a* to different bottle shapes and/or diameters. The plate element 17 in this exemplary embodiment is in turn fabricated, at least in the peripheral area that interacts with the permanent magnet, from a ferromagnetic material, for example from a suitable metal. The plate element that has the friction lining 10 is fabricated from a suitable metal or plastic. The friction lining 10 can be fastened to this plate element by adhesive, for example.

Figure 6:
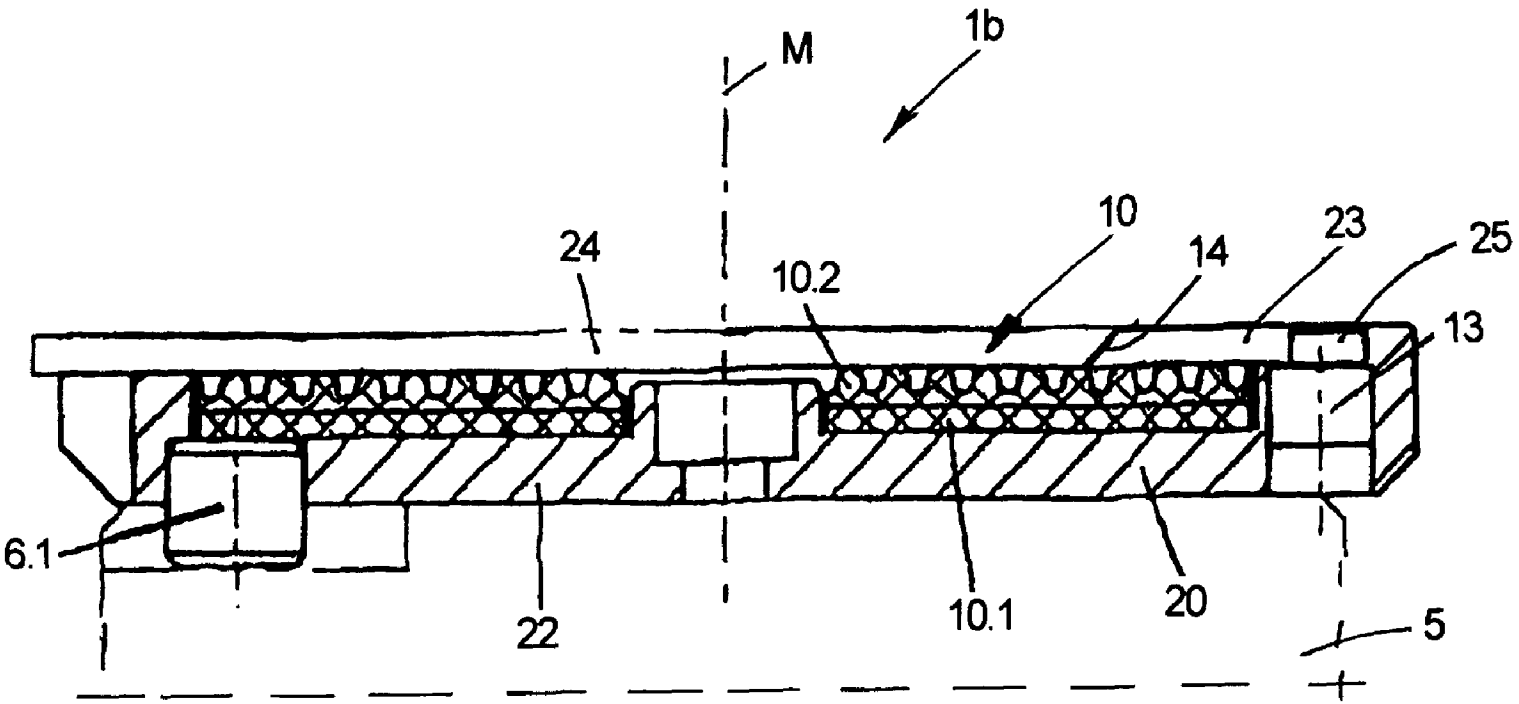
FIG. 6 shows an additional exemplary embodiment.

FIG. 6 shows, in an illustration analogous to FIG. 4, a container plate support table 1*b* which is simplified with respect to container plate support table 1*a*, and in which the friction lining 10, which comprises the bottom fabric ply 10.1 and the overlying ply 10.2 which can be made of rubber, for example, and has a textured upper side, is fastened by adhesive in a ring-shaped depression that concentrically surrounds the center axis M in a bottle plate bottom part 22 that corresponds to the bottle plate bottom part 4. On the upper side of the bottle plate bottom part 22 which is fastened with its underside to the rotation device 5, there is a replaceable bottle plate top part 23 which corresponds to the bottle plate top part 7*b*, and specifically with the central recess 24 that forms the diagonal centering surface 14 within which the friction lining 10 lies exposed or unattached.

The bottle plate top part 23 is in turn held in place by the tab-like extensions of the bottle plate top part 23 that are engaged on the edge of the bottle plate top part 22 to prevent rotation and by the permanent magnets 13 to prevent separation.

The present application was described above on the basis of exemplary embodiments. It goes without saying that numerous modifications and variants are possible without thereby going beyond the teaching on which the present application is based.

In the above description, it has been assumed that the bottle plate top parts that interact with the permanent magnets 13 are made of a ferromagnetic material. As indicated in FIG. 6 with 25 for the bottle plate top part 23, it is also possible to manufacture the bottle plate top parts from ferromagnetic material only where they interact with the permanent magnets 13, or to provide them with inserts made of ferromagnetic material.

Figure 1B:
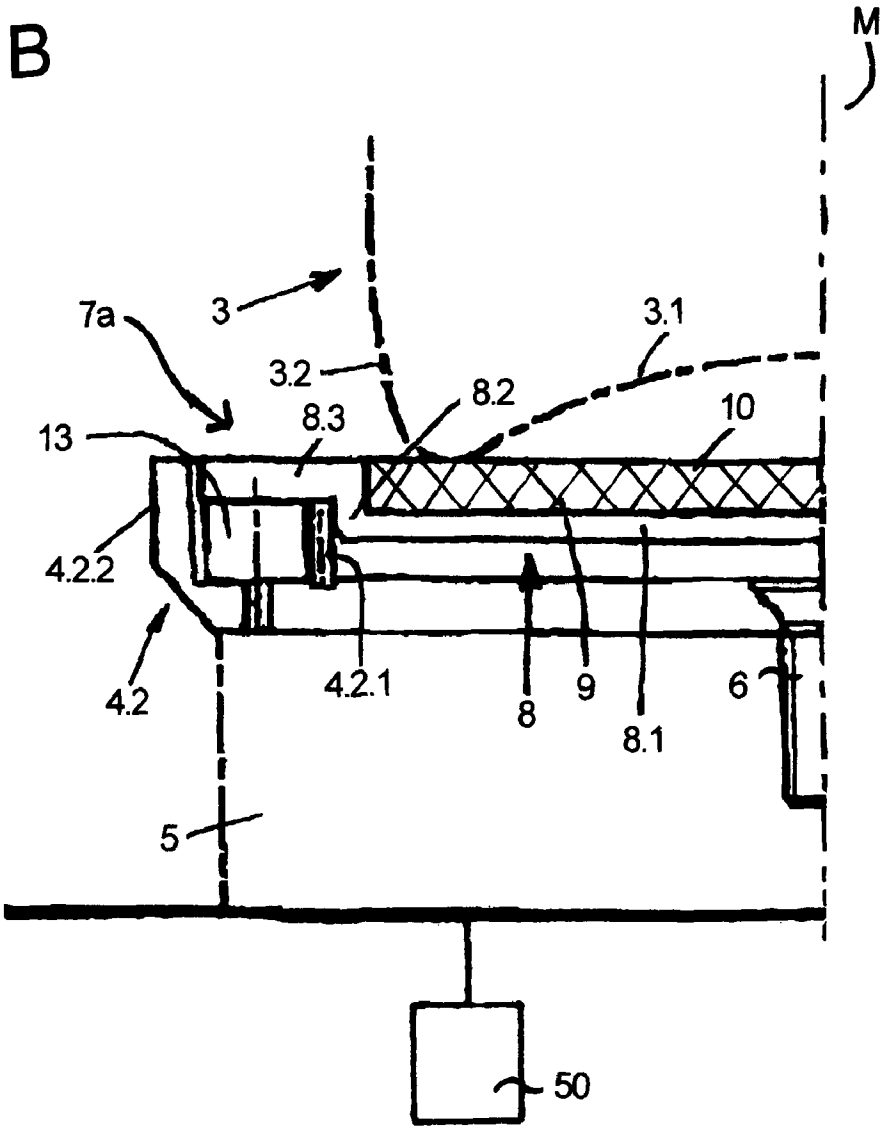
FIG. 1B is a simplified section through an embodiment of a two-part bottle plate along the line IB-IB in FIG. 3A.
Figure 1C:
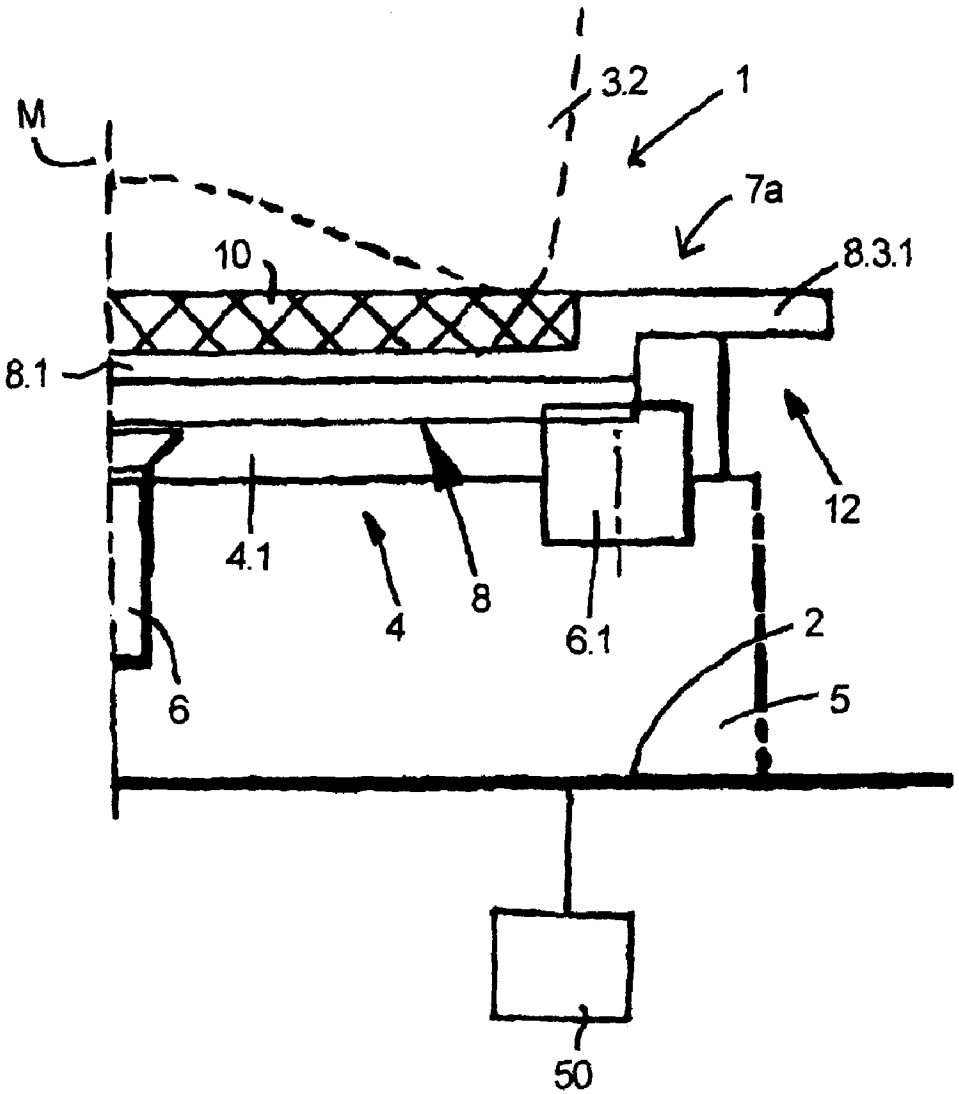
FIG. 1C is a simplified section through an embodiment of a two-part bottle plate along the line IC-IC in FIG. 3A.
Figure 3:
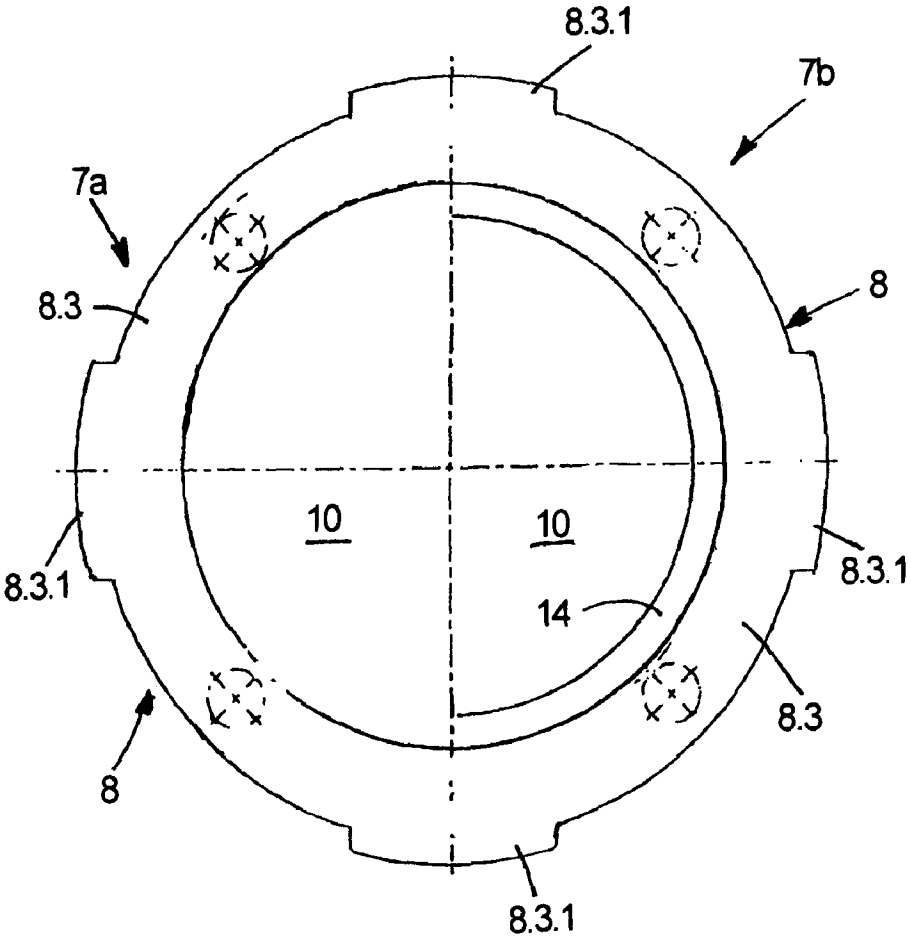
Figure 3A:
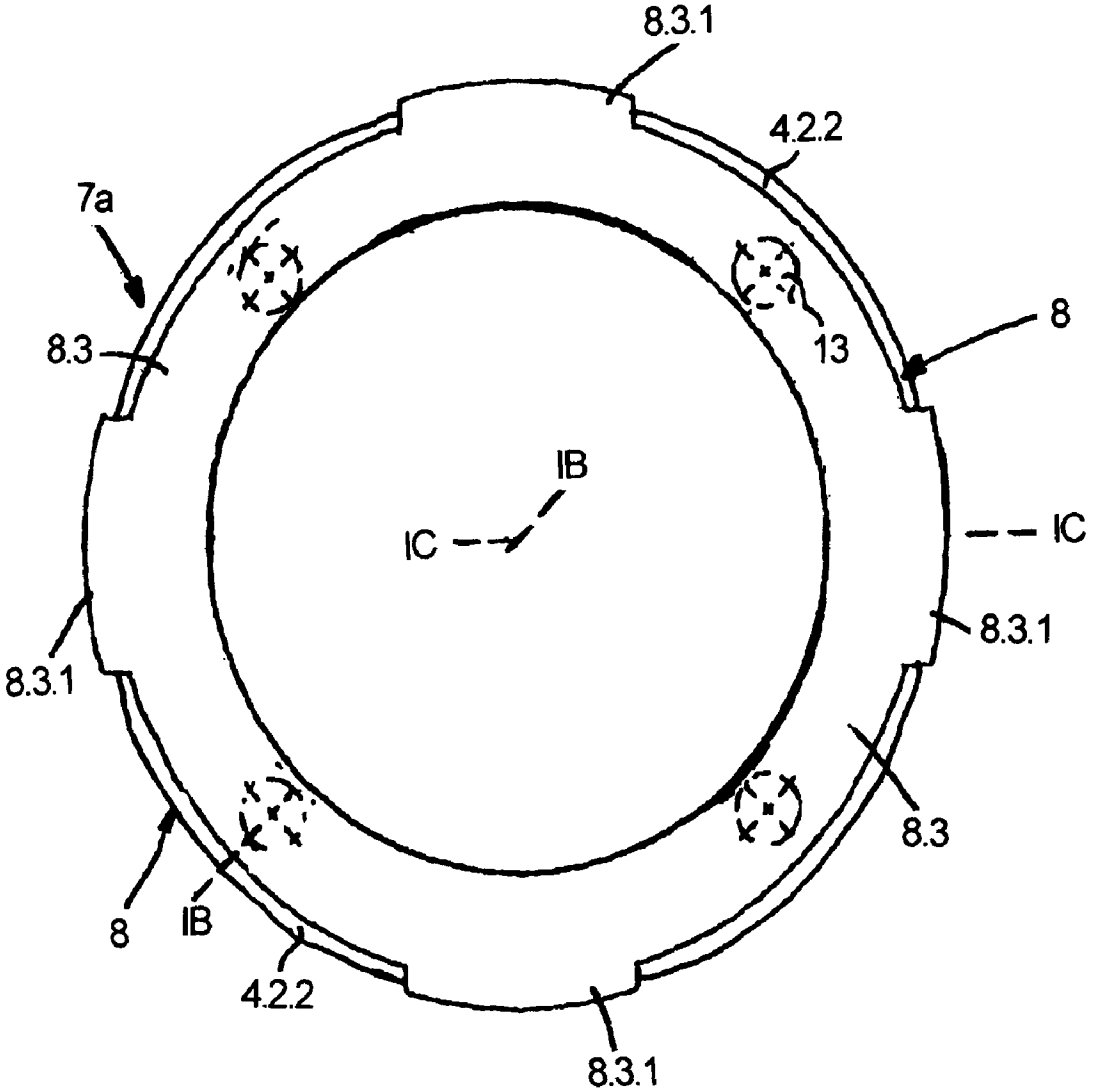
FIG. 3A is a simplified plan view of an embodiment of the bottle plate upper part according to the left side of FIG. 3.

FIG. 1B is a simplified section through an embodiment of a two-part bottle plate along the line IB in FIG. 3A. FIG. 1B is in accordance with the embodiment shown on the left side of FIG. 1. FIG. 1C is a simplified section through an embodiment of a two-part bottle plate along the line IC in FIG. 3A. FIG. 1C illustrates the same embodiment shown on the left side of FIG. 1, and the embodiment shown in FIG. 1B. FIGS. 1B and 1C further show a cam control system or a servo-drive 50 for the rotation of the rotation device 5.

Figure 1D:
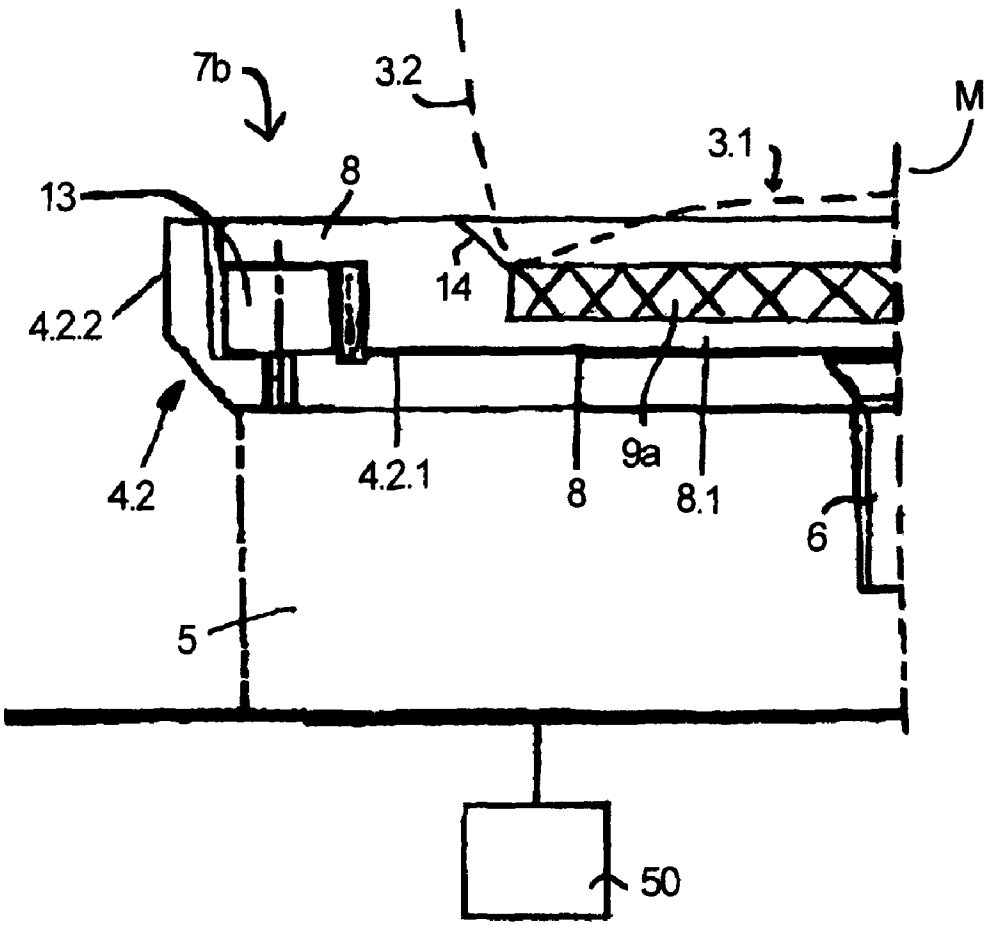
FIG. 1D is a simplified section through an embodiment of a two-part bottle plate along the line ID-ID in FIG. 3B.
Figure 1E:
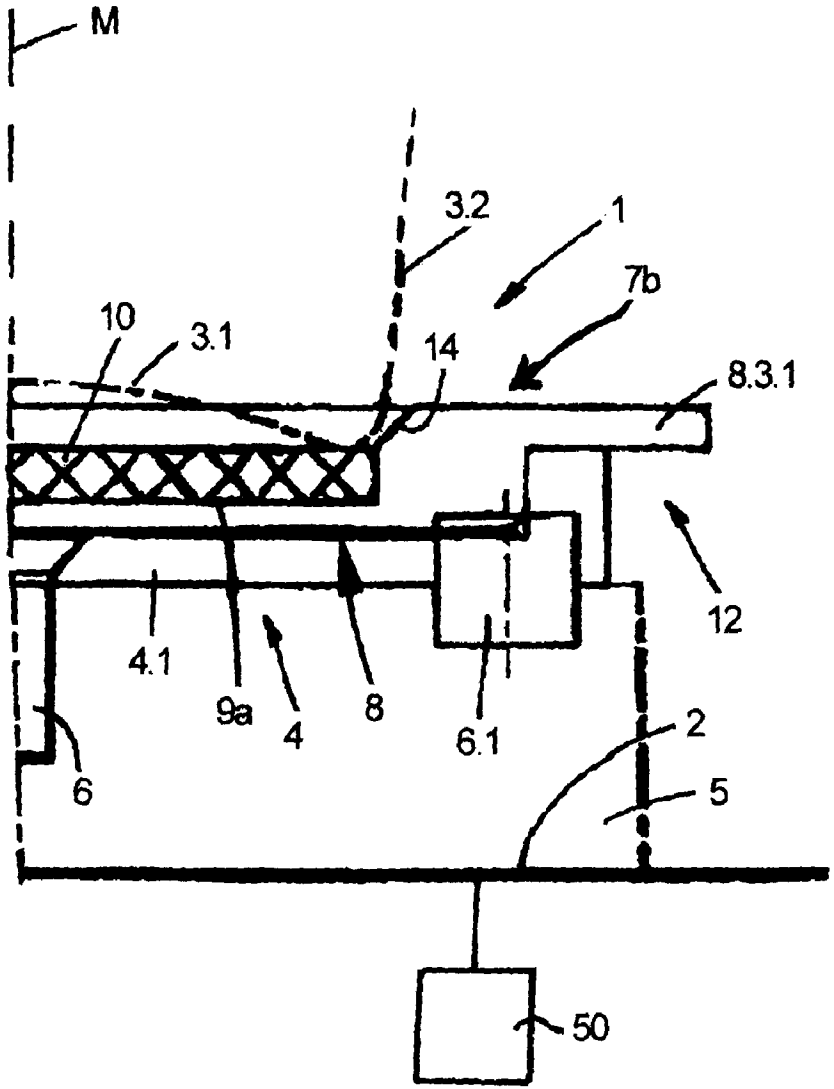
FIG. 1E is a simplified section through an embodiment of a two-part bottle plate along the line IE-IE in FIG. 3B.
Figure 3B:
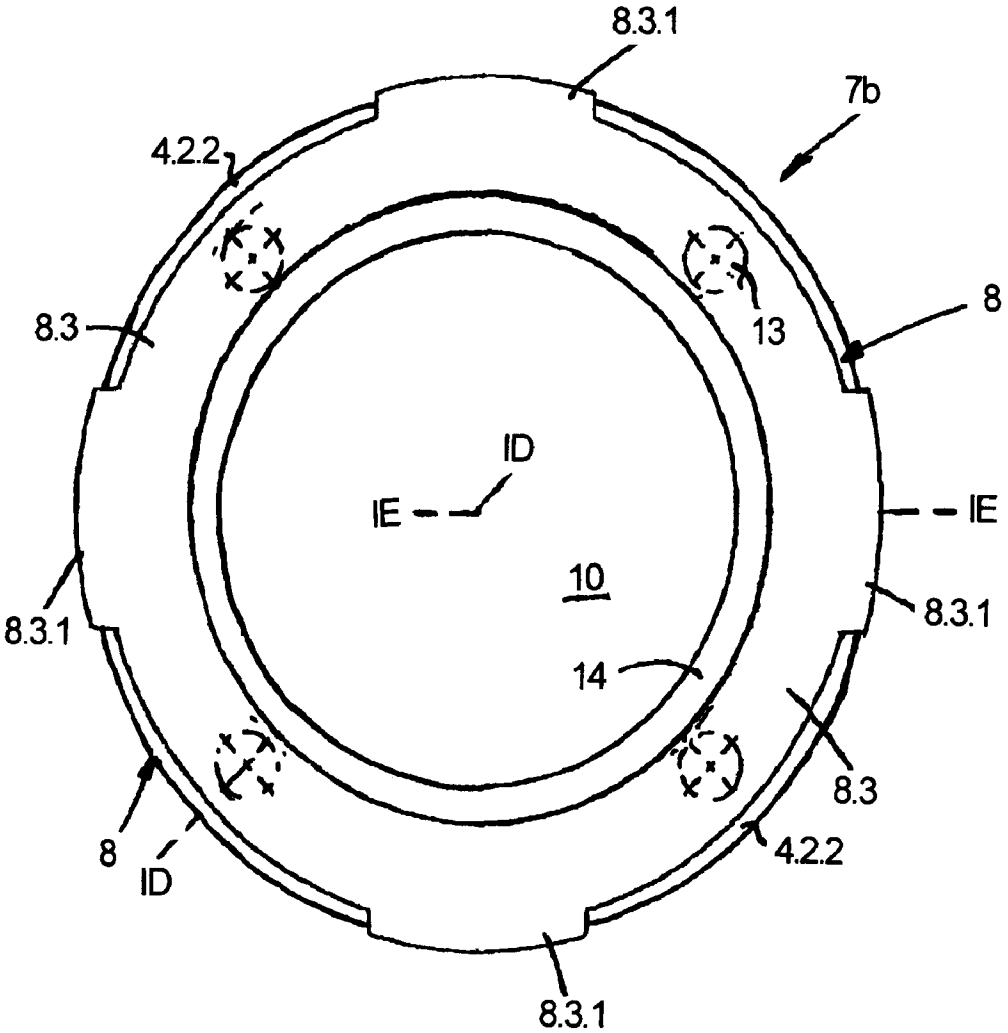
FIG. 3B is a simplified plan view of an embodiment of the bottle plate upper part according to the right side of FIG. 3.

FIG. 1D is a simplified section through an embodiment of a two-part bottle plate along the line ID in FIG. 3B. FIG. 1D is in accordance with the embodiment shown on the right side of FIG. 1. FIG. 1E is a simplified section through an embodiment of a two-part bottle plate along the line IE in FIG. 3B. FIG. 1E illustrates the same embodiment shown on the right side of FIG. 1, and the embodiment shown in FIG. 1D. FIGS. 1D and 1E further show a cam control system or a servo-drive 50 for the rotation of the rotation device 5.

As described herein above, the substantially circular top portion 7B illustrated in FIGS. 1D and 1E differs from the substantially circular top portion 7A illustrated in FIGS. 1B and 1C only in that the recess 9A (FIGS. 1D and 1E) which corresponds to the recess 9 (FIGS. 1B and 1C) and is designed to hold the friction lining 10 is deeper than the recess 9, so that the friction lining 10 lies lower with its upper side than the upper side of the flange segment 8.3. At the transition between the upper side of the flange 8.3 and the upper side of the friction lining 10, there is a conical ring-shaped centering surface 14 that concentrically encircles the center axis M, and specifically at a conical angle which, in the illustration selected for FIGS. 1C and 1D, opens toward the top. The centering surface 14, as illustrated in FIGS. 1C and 1D, interacts with the respective bottle 3 at the transition between the bottle base 3.1 and the bottle peripheral wall 3.2, to also center the bottle 3 on the container plate support table 1.

FIG. 3A is a simplified plan view of an embodiment of the bottle plate upper part according to the left side of FIG. 3. FIG. 3A corresponds to the embodiment of the substantially circular top portion 7A shown in FIGS. 1B and 1C. Also shown in FIG. 3A is the segment 4.2.2 of the substantially circular bottom portion 4. The segment 4.2.2 extends beyond the edge of the substantially circular top portion 8, such that the segment 4.2.2 can be seen between the tab-like extensions 8.3.1 when the substantially circular top portion 8 is installed on top of the substantially circular bottom portion 4 during container processing. FIG. 3A further shows the lines IB and IC, which correspond to FIGS. 1B and 1C, respectively.

Figure 4A:
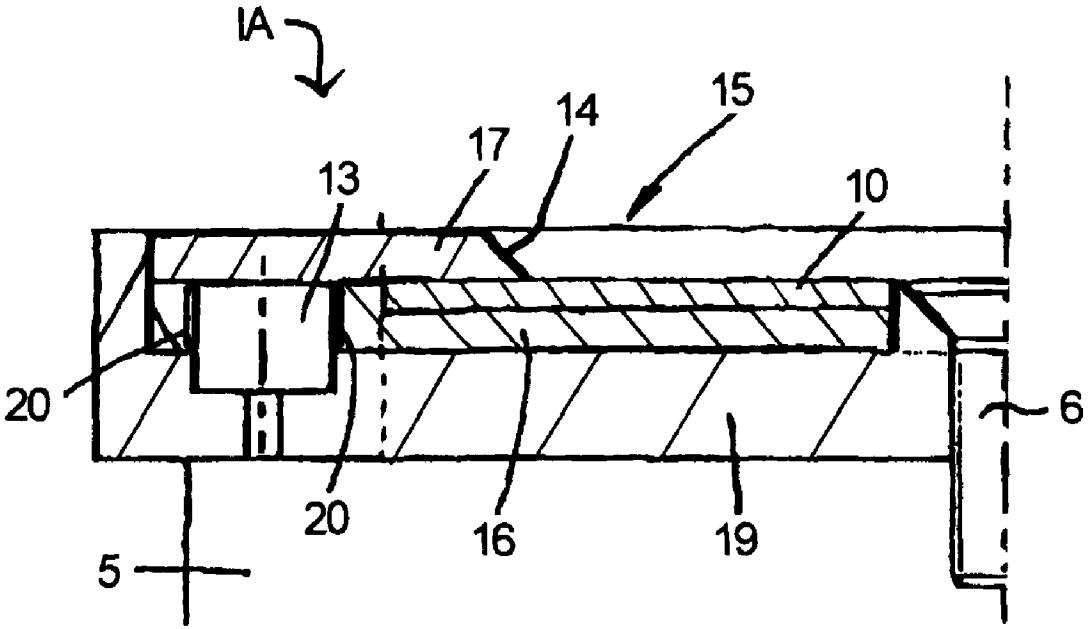
FIG. 4A is a simplified view in section through a three-piece bottle plate according to the right side of FIG. 4.
Figure 4B:
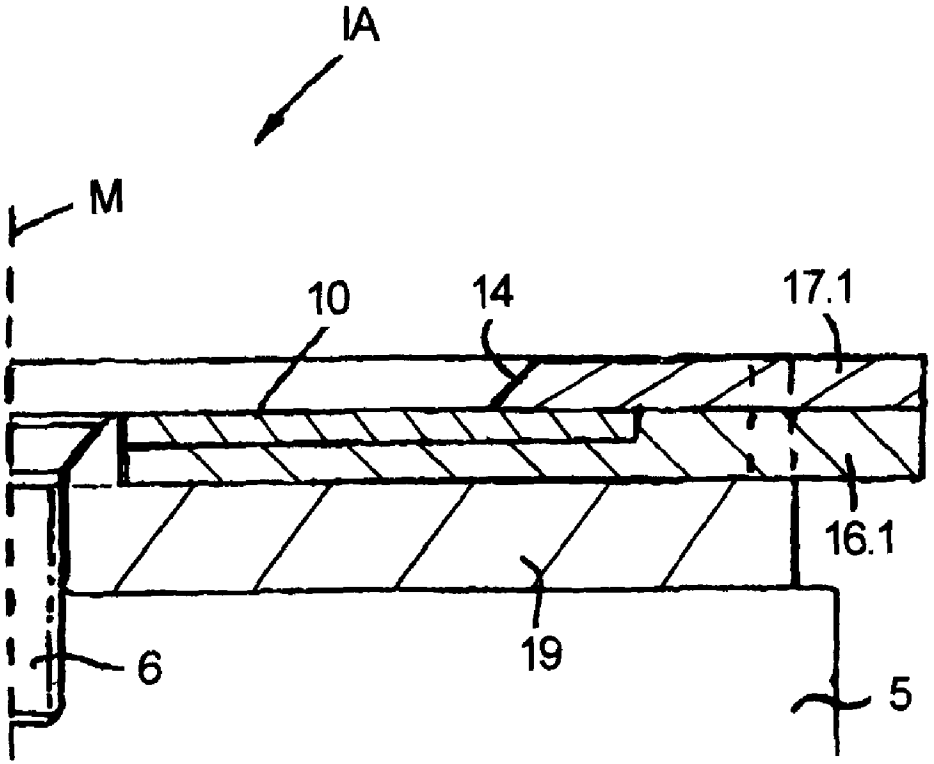
FIG. 4B is a simplified view in section through a three-piece bottle plate according to the left side of FIG. 4.

FIG. 3B is a simplified plan view of an embodiment of the bottle plate upper part according to the right side of FIG. 3. FIG. 3B corresponds to the embodiment of the substantially circular top portion 7B shown in FIGS. 1D and 1E. Also shown in FIG. 3B is the segment 4.2.2 of the substantially circular bottom portion 4. The segment 4.2.2 extends beyond the edge of the substantially circular top portion 8, such that the segment 4.2.2 can be seen between the tab-like extensions 8.3.1 when the substantially circular top portion 8 is installed on top of the substantially circular bottom portion 4 during container processing. Also shown in FIG. 3B is the conical ring-shaped centering surface 14, according to the embodiment shown in FIGS. 1D and 1E. FIG. 3B further shows the lines ID and IE, which correspond to FIGS. 1D and 1E, respectively FIG. 4A is a simplified view in section through a three-piece bottle plate according to the right side of FIG. 4. FIG. 4B is a simplified view in section through a three-piece bottle plate according to the left side of FIG. 4.

Figure 6A:
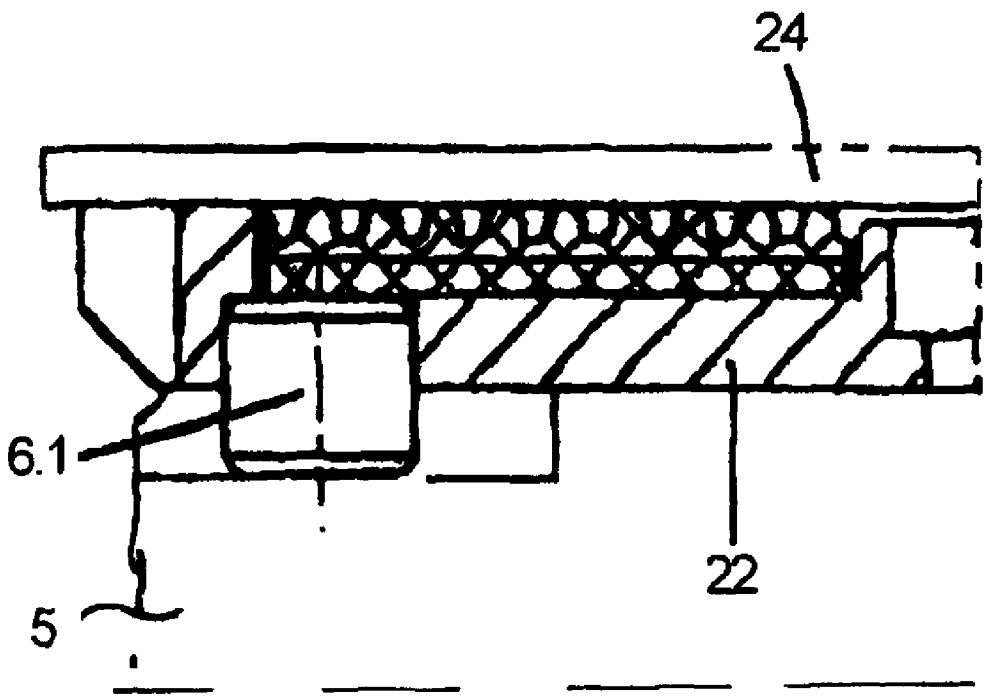
FIG. 6A shows an additional embodiment according to the left side of FIG. 6.
Figure 6B:
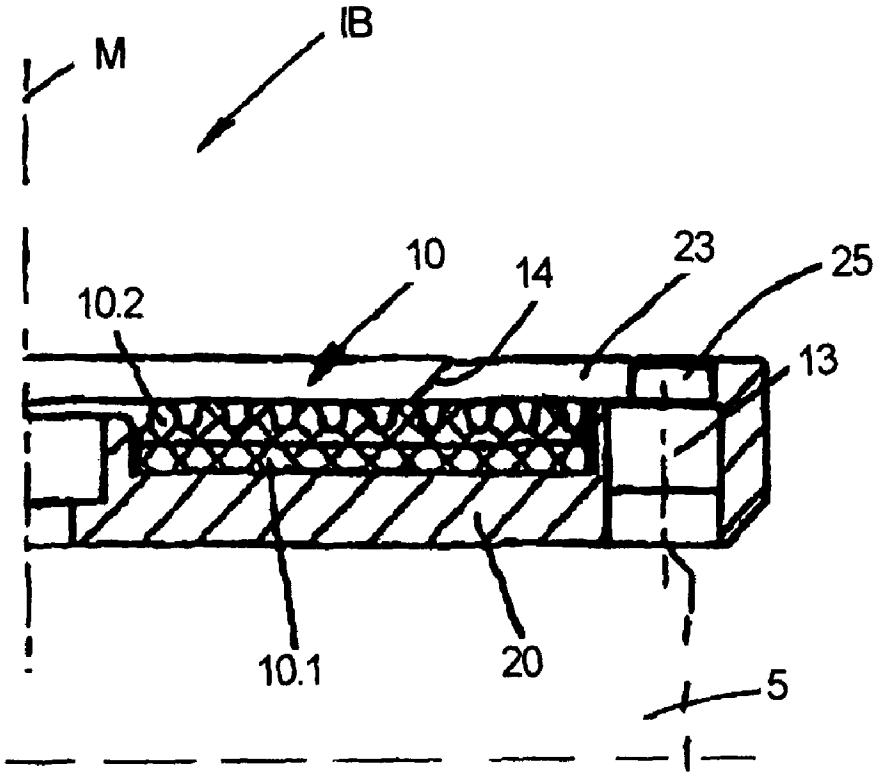
FIG. 6B shows an additional embodiment according to the right side of FIG. 6.

FIG. 6A shows an additional embodiment according to the left side of FIG. 6, and FIG. 6B shows an additional embodiment according to the right side of FIG. 6.

The present application relates to a bottle plate or container plate support table for use on container or bottle handling machines in the form of a container support surface that is formed by a friction lining and can be rotated in a controlled manner around a vertical bottle plate center axis, whereby the bottle plate is realized in at least two parts with a bottle plate bottom part that can be fastened to a rotation device of the handling machine and with a bottle plate top part that is replaceably fastened to the bottle plate bottom part.

One feature or aspect of an embodiment is believed at the time of the filing of this patent application to possibly reside broadly in a bottle plate for use in container or bottle handling machines, for example in labeling machines, as a container support surface that is formed by a friction lining and can be rotated in a controlled manner around a bottle plate center axis, characterized in that the bottle plate is realized in at least two parts with a bottle plate bottom part that can be fastened to a rotation device of the handling machine and with at least one bottle plate top part that can be replaceably or interchangeably fastened to the bottle plate bottom part and is secured against rotation by a form-fitting engagement of the bottle plate bottom part and bottle plate top part, and is held securely on the bottle plate bottom part by detachable interlock means to prevent separation.

Another feature or aspect of an embodiment is believed at the time of the filing of this patent application to possibly reside broadly in a bottle plate, characterized in that the detachable interlock means are formed by at least one permanent magnet.

Yet another feature or aspect of an embodiment is believed at the time of the filing of this patent application to possibly reside broadly in a bottle plate, characterized in that at least two permanent magnets are distributed around the bottle plate center axis and are provided at some radial distance from said center axis.

Still another feature or aspect of an embodiment is believed at the time of the filing of this patent application to possibly reside broadly in a bottle plate, characterized by the fact that the replaceable bottle plate top part has the friction lining.

A further feature or aspect of an embodiment is believed at the time of the filing of this patent application to possibly reside broadly in a bottle plate, characterized in that the replaceable bottle plate top part is realized in the form of a centering element for the bottles or similar containers with a centering surface that encircles the friction lining at least in partial areas.

Another feature or aspect of an embodiment is believed at the time of the filing of this patent application to possibly reside broadly in a bottle plate, characterized in that the friction lining is provided on the bottle plate bottom part.

Yet another feature or aspect of an embodiment is believed at the time of the filing of this patent application to possibly reside broadly in a bottle plate, characterized by the fact that the bottle plate top part is realized in at least two parts with two plate elements located one on top of the other.

Still another feature or aspect of an embodiment is believed at the time of the filing of this patent application to possibly reside broadly in a bottle plate, characterized in that a top plate element which lies at some distance from the bottle plate bottom part, is realized in the form of the centering plate with a centering surface and a plate portion that lies closer to or next to the bottle plate bottom part has the friction lining or forms said lining.

A further feature or aspect of an embodiment is believed at the time of the filing of this patent application to possibly reside broadly in a bottle plate, characterized in that the bottle plate top part is provided with at least one tab-like segment that projects beyond the edge of this top part, which tab-like segment engages in a recess that is open on the upper side of the bottle plate bottom part to form a non-rotational connection between the bottle plate top part and the bottle plate bottom part.

Another feature or aspect of an embodiment is believed at the time of the filing of this patent application to possibly reside broadly in a bottle plate, characterized in that when the bottle plate top part is realized in two parts, at least one plate element that forms the upper side of the bottle plate has the tab-like segment.

Yet another feature or aspect of an embodiment is believed at the time of the filing of this patent application to possibly reside broadly in a bottle plate, characterized in that all the plate elements of the bottle plate top part have at least one projecting tab-like segment, and that the tab-like segments are each received in a recess, for example a common recess, in the bottle plate bottom part.

Still another feature or aspect of an embodiment is believed at the time of the filing of this patent application to possibly reside broadly in a bottle plate, characterized in that the at least one tab-like segment forms a handle surface for the removal of the bottle plate top part.

A further feature or aspect of an embodiment is believed at the time of the filing of this patent application to possibly reside broadly in beverage bottling plant for filling bottles with liquid beverage material, said beverage bottling plant comprising: a plurality of rotary machines comprising at least a rotary bottle filling machine and a rotary bottle closing machine; a first conveyor arrangement being configured and disposed to convey bottles to be filled to said bottle filling machine; said bottle filling machine being configured and disposed to fill bottles with liquid beverage material; said bottle filling machine comprising: a rotor; a rotatable vertical machine column; said rotor being connected to said vertical machine column to permit rotation of said rotor about said vertical machine column; a plurality of bottle filling elements for filling bottles with liquid beverage material being disposed on the periphery of said rotor; each of said plurality of bottle filling elements comprising a bottle carrier being configured and disposed to receive and hold beverage bottles to be filled; each of said plurality of bottle filling elements being configured and disposed to dispense liquid beverage material into bottles to be filled; at least one liquid reservoir being configured to hold a supply of liquid beverage material; at least one supply line being configured and disposed to connect said at least one liquid reservoir to said bottle filling machine to supply liquid beverage material to said bottle filling machine; a first filling machine star wheel structure being configured and disposed to move bottles into said bottle filling machine; and a second filling machine star wheel structure being configured and disposed to move bottles out of said bottle filling machine; a second conveyor arrangement being configured and disposed to convey filled bottles to said bottle closing machine; said bottle closing machine being configured and disposed to close tops of filled bottles; said bottle closing machine comprising: a rotor; a rotatable vertical machine column; said rotor being connected to said vertical machine column to permit rotation of said rotor about said vertical machine column; a plurality of closing devices being disposed on the periphery of said rotor; each of said plurality of closing devices being configured and disposed to place closures on filled bottles; each of said plurality of closing devices comprising a bottle carrier being configured and disposed to receive and hold filled bottles; a first closing machine star wheel structure being configured and disposed to move filled bottles into said bottle closing machine; and a second closing machine star wheel structure being configured and disposed to move filled, closed bottles out of said bottle closing machine; at least one of said bottle filling machine and said bottle closing machine comprising at least one bottle plate support table; said at least one bottle plate support table being disposed on said rotor of at least one of said bottle filling machine and said bottle closing machine; said at least one bottle plate support table comprising: a first substantially circular top plate portion being configured and disposed to support a bottle thereon; a second substantially circular top plate portion being configured and disposed to hold a different bottle than said first substantially circular top plate portion; a substantially circular bottom plate portion; said substantially circular bottom plate portion being connected to said rotor of at least one of said bottle filling machine and said bottle closing machine with a connecting element; said bottle plate support table being configured and disposed to be rotated in a controlled rotation about a vertical axis in at least one of said bottle filling machine and said bottle closing machine; said substantially circular bottom plate portion comprising: a disc-shaped plate element; a substantially circular depression being disposed in said disc-shaped plate element; an outer ring-shaped edge being disposed about the circumference of said disc-shaped plate element; a plurality of recesses being disposed about the periphery of said outer ring-shaped edge; said substantially circular top plate portion being detachably disposed on top of said substantially circular bottom plate portion; said substantially circular top plate portion comprising: a disc-shaped plate element being configured and disposed to matingly engage with said substantially circular depression of said substantially circular bottom plate portion; a friction lining being configured and disposed to hold a bottle thereon; a ring-shaped flange being disposed about the circumference of said disc-shaped plate element; a plurality of tab-like extensions being disposed about the periphery of said ring-shaped flange; said plurality of tab-like extensions being configured and disposed to matingly engage with said plurality of recesses of said substantially circular bottom plate portion, and to substantially prevent separation of said substantially circular top plate portion from said substantially circular bottom plate portion; said plurality of tab-like extensions being configured and disposed to matingly engage with said plurality of recesses of said substantially circular bottom plate portion to substantially restrict or limit rotation of said substantially circular top plate portion with respect to said substantially circular bottom plate portion; an interlock device being configured and disposed to prevent separation of said substantially circular top portion from said substantially circular bottom portion; and said substantially circular bottom plate portion being configured and disposed to support said first substantially circular top plate portion and said second substantially circular top plate portion.

Another feature or aspect of an embodiment is believed at the time of the filing of this patent application to possibly reside broadly in a container filling plant for filling containers with a filling material, said container filling plant comprising: a plurality of container handling machines comprising at least one of a filling machine and a closing machine; said filling machine being configured and disposed to fill empty containers with a filling material; a first transfer arrangement being configured and disposed to move containers to said filling machine; said filling machine comprising: a moving device being configured and disposed to accept containers from said first moving arrangement and to move containers in said filling machine; and at least one filling device being configured and disposed to fill containers with a filling material upon the containers being in said filling machine; said closing machine being configured and disposed to close filled containers; a second transfer arrangement being configured and disposed to accept filled containers from said moving device of said filling machine to move filled containers out of said filling machine; said second transfer arrangement being configured and disposed to move filled containers from said filling machine to said closing machine; said closing machine comprising: a moving device being configured and disposed to accept filled containers from said second moving arrangement and to move filled containers in said closing machine; and at least one closing device being configured and disposed to close filled containers upon the filled containers being in said closing machine; a third transfer arrangement being configured and disposed to accept closed containers from said moving device of said closing machine to move closed containers out of said closing machine; at least one of said container handling machines comprising at least one container plate support table; said at least one container plate support table being disposed on a turning mechanism in at least one of said container handling machines; said turning mechanism being configured and disposed to turn containers in said container handling machines; said container plate support table being configured and disposed to be rotated in a controlled rotation about a vertical axis; said at least one container plate support table comprising: a top plate portion and a bottom plate portion; said bottom plate portion being connected to said turning mechanism of at least one of said container handling machines with a connecting element; said bottom plate portion comprising an outer edge portion being disposed about the periphery of said bottom plate portion; said bottom plate portion comprising a plurality of recesses being disposed about the periphery of said outer edge portion; said top plate portion being detachably disposed on top of said bottom plate portion; said top plate portion being configured and disposed to matingly engage with said bottom plate portion; said top plate portion comprising a friction lining being configured and disposed to hold a container thereon; said top plate portion comprising a plurality of tab-like extensions being disposed about the periphery of said top plate portion; said plurality of tab-like extensions being configured and disposed to matingly engage with said plurality of recesses of said bottom plate portion, and to substantially prevent separation of said top plate portion from said bottom plate portion; said plurality of tab-like extensions being configured and disposed to matingly engage with said plurality of recesses of said bottom plate portion to substantially restrict or limit rotation of said top plate portion with respect to said bottom plate portion; and an interlock device being configured and disposed to prevent separation of said top plate portion from said bottom plate portion.

Yet another feature or aspect of an embodiment is believed at the time of the filing of this patent application to possibly reside broadly in: In a container filling plant for filling containers with a filling material, a plate support arrangement being configured and disposed to support containers in a container handling machine, such as a filling machine, a closing machine, and a labeling machine, said plate support arrangement comprising: a plate support device being configured and disposed to support containers in a container handling machine; a turning mechanism being configured and disposed to rotate said plate support device in a controlled rotation about a vertical axis; said plate support device comprising a top plate portion and a bottom plate portion; said top plate portion and said bottom plate portion being configured to be engaged to prevent separation of said top plate portion from said bottom plate portion and to substantially restrict or limit rotation of said top plate portion with respect to said bottom plate portion; an interlock device being configured and disposed to substantially prevent separation of said top plate portion from said bottom plate portion at least upon a container being supported on said top plate portion, and to permit detachment of said top plate portion from said bottom plate portion upon a container not being supported on said top plate portion; and said plate support device comprising a friction lining being configured and disposed to support a container thereon.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. patents assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. Pat. No. 5,398,485 issued to Osifchin on Mar. 21, 1995; No. 5,402,623 issued to Ahlers on Apr. 4, 1995; No. 5,419,094 issued to Vander Bush, Jr. et al. on May 30, 1995; No. 5,425,402 issued to Pringle on Jun. 20, 1995; No. 5,447,246 issued to Finke on Sep. 5, 1995; and No. 5,449,080 issued to Finke on Sep. 12, 1995.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; No. 6,373,209 issued to Gerber et al. on Apr. 16, 2002; No. 6,424,061 issued to Fukuda et al. on Jul. 23, 2002; No. 6,509,663 issued to Aoun on Jan. 21, 2003; No. 6,548,923 to Ohnishi et al. on Apr. 15, 2003; and No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; No. 4,365,538 issued to Andoh on Dec. 28, 1982; No. 4,550,626 issued to Brouter on Nov. 5, 1985; No. 4,760,699 issued to Jacobsen et al. on Aug. 2, 1988; No. 5,076,568 issued to de Jong et al. on Dec. 31, 1991; and No. 6,025 issued to Yasui on Feb. 15, 2000.

All, or substantially all, of the components and methods of the various embodiments may be used with at least one embodiment or all of the embodiments, if more than one embodiment is described herein.

Some examples of synchronous motors which may possibly be utilized or adapted for use in at least one possible embodiment may possibly be found in the following U.S. Pat. No. 6,713,899, entitled "Linear synchronous motor;" No. 6,486,581, entitled "Interior permanent magnet synchronous motor;" No. 6,424,114, entitled "Synchronous motor;" No. 6,388,353, entitled "Elongated permanent magnet synchronous motor;" No. 6,329,728, entitled "Cylinder-type linear synchronous motor;" No. 6,025,659, entitled "Synchronous motor with movable part having permanent magnets;" No. 5,936,322, entitled "Permanent magnet type synchronous motor;" and No. 5,448,123, entitled "Electric synchronous motor."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Pat. No. 5,416,480 issued to Roach et al. on May 16, 1995; No. 5,479,355 issued to Hyduke on Dec. 26, 1995; No. 5,481,730 issued to Brown et al. on Jan. 2, 1996; No. 5,805,094 issued to Roach et al. on Sep. 8, 1998; No. 5,881,227 issued to Atkinson et al. on Mar. 9, 1999; and No. 6,072,462 issued to Moshovich on Jun. 6, 2000.

All of the patents, patent applications and publications recited herein, and in the Declaration attached hereto, are hereby incorporated by reference as if set forth in their entirety herein.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign patent publication applications, namely, Federal Republic of Germany Patent Application No. 10 2004 054 891.9, filed on Nov. 12, 2004, having inventor Heinz Thielmann, and DE-OS 10 2004 054 891.9 and DE-PS 10 2004 054 891.9, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OF TERMS

1, 1*a* 1*b* Bottle plate
2 Rotor or turntable of a bottle handling machine
3 Bottle
3.1 Bottle base
3.2 Bottle peripheral wall
4 Bottle plate bottom part
4.1 Base
4.2 Edge
4.2.1, 4.2.2 Segment of edge 4.2
5 Rotation device
6 Fastening screw
6.1 Lug
7, 7*a* Bottle plate top part
8 Plate element
8.1 Base
8.2 Edge
8.3 Flange
8.3.1 Tab-like extension to prevent rotation
9, 9*a* Recess
10 Friction lining
10.1 Fabric ply
10.2 Wear-resistant friction lining top ply made of plastic
11 Recess for the tab-like extensions 8.3.1
12 Notch on the periphery of the bottle plate bottom part 4
13 Permanent magnet
14 Conical ring-shaped centering surface
15 Bottle plate top part

16, 17 Plate elements
16.1, 17.1 Tab-like extension to prevent rotation
18 Recess on the edge of the bottle plate bottom part
19 Bottle plate bottom part
20 Boring
21 Recess in the bottle plate bottom part 22
22 Bottle plate bottom part
23 Bottle plate top part
24 Opening in the bottle plate top part 23 with centering surface 14
M Vertical center axis

What is claimed is:

1. A plate support arrangement being configured to support containers in a container handling machine, said plate support arrangement comprising:

a plate support device being configured and disposed to support containers in a container handling machine;

a turning mechanism being configured and disposed to rotate said plate support device in a controlled rotation about a vertical axis;

said plate support device comprising a top plate portion and a bottom plate portion;

said top plate portion and said bottom plate portion being configured to be engaged to prevent separation of said top plate portion from said bottom plate portion and to substantially restrict or limit rotation of said top plate portion with respect to said bottom plate portion;

an interlock device being configured and disposed to substantially prevent separation of said top plate portion from said bottom plate portion at least upon a container being supported on said top plate portion, and to permit detachment of said top plate portion from said bottom plate portion upon a container not being supported on said top plate portion;

said plate support device comprising a friction lining being configured and disposed to support a container thereon;

said top plate portion comprising a recess being configured and disposed to receive and hold said friction lining therein;

said friction lining being permanently affixed in said recess of said top plate portion;

said top plate portion being detachably connected to said bottom plate portion to permit removal of said top plate portion from said bottom plate portion upon said friction lining being substantially worn or upon a change in the dimensional size or shape of the bottles being handled, and to permit replacement of said top plate portion with another top plate portion having a new or less worn friction lining or being configured to handle bottles of a different dimensional size or shape;

said top plate portion comprises a plurality of tab-like extensions disposed about the periphery of said top plate portion, and being disposed to extend substantially radially away from other portions of said top plate portion;

portions of each of said plurality of tab-like extensions are disposed a further distance from the center of said top plate portion than other portions of said top plate portion; and said interlock device is formed by at least one permanent magnet.

2. The plate support arrangement according to claim 1, wherein:

said bottom plate portion comprises an outer edge portion disposed about the periphery of said bottom plate portion;

said bottom plate portion comprises a plurality of recesses disposed about the periphery of said outer edge portion;

said plurality of tab-like extensions are configured and disposed to matingly engage with said plurality of recesses of said bottom plate portion, and to substantially prevent separation of said top plate portion from said bottom plate portion; and said plurality of tab-like extensions are configured and disposed to matingly engage with said plurality of recesses of said bottom plate portion to substantially restrict or limit rotation of said top plate portion with respect to said bottom plate portion.

3. The plate support arrangement according to claim 2, wherein said tab-like extensions are disposed spaced apart from one another about the periphery of said top plate portion.

4. The plate support arrangement according to claim 3, wherein each of said recesses of said bottom plate portion is configured to extend substantially less than 360 degrees over a portion of the periphery of said outer edge portion.

5. The plate support arrangement according to claim 4, wherein at least two permanent magnets are distributed around the plate support arrangement center axis, and are provided at some radial distance from said center axis.

6. The plate support arrangement according to claim 5, wherein said top plate portion is realized in the form of a centering element for bottles or similar containers with a centering surface that encircles said friction lining at least in partial areas.

7. The plate support arrangement according to claim 6, wherein said top plate portion comprises a top plate element and a bottom plate element located one on top of the other and detachably connected to another.

8. The plate support arrangement according to claim 7, wherein said tab-like extensions form a handle for the removal of said top plate portion.

9. The plate support arrangement according to claim 1, wherein said plate support arrangement comprises a top plate portion replacement kit comprising a plurality of top plate portions being configured to be detachably connected to said bottom plate portion.

10. The plate support arrangement according to claim 1, wherein:

said top plate portion comprises a first top plate element and a second top plate element;

said second top plate element is disposed between said first top plate element and said bottom plate portion;

said first top plate element comprises said plurality of tab-like extensions;

said first top plate element comprises a centering element for bottles or similar containers with a centering surface that covers said friction lining at least in partial areas; and said friction lining is permanently affixed to said second top plate element.

11. The plate support arrangement according to claim 10, wherein said second top plate element comprises a plurality of tab-like extensions which correspond to said plurality of tab-like extensions of said first top plate element.

12. A plate support arrangement being configured to support containers in a container handling machine, said plate support arrangement comprising:

a plate support device being configured and disposed to support containers in a container handling machine;

a turning mechanism being configured and disposed to rotate said plate support device in a controlled rotation about a vertical axis;

said plate support device comprising a top plate portion and a bottom plate portion;

said top plate portion and said bottom plate portion being configured to be engaged to prevent separation of said top plate portion from said bottom plate portion and to substantially restrict or limit rotation of said top plate portion with respect to said bottom plate portion;

an interlock device being configured and disposed to substantially prevent separation of said top plate portion from said bottom plate portion at least upon a container being supported on said top plate portion, and to permit detachment of said top plate portion from said bottom plate portion upon a container not being supported on said top plate portion;

said plate support device comprising a friction lining being configured and disposed to support a container thereon;

said top plate portion comprising a recess being configured and disposed to receive and hold said friction lining therein;

said friction lining being permanently affixed in said recess of said bottom plate portion;

said top plate portion being detachably connected to said bottom plate portion to permit removal of said top plate portion from said bottom plate portion upon a change in the dimensional size or shape of the bottles being handled, and to permit replacement of said top plate portion with another top plate portion being configured to handle bottles of a different dimensional size or shape;

said top plate portion comprises a plurality of tab-like extensions disposed about the periphery of said top plate portion, and being disposed to extend substantially radially away from other portions of said top plate portion;

portions of each of said plurality of tab-like extensions are disposed a further distance from the center of said top plate portion than other portions of said top plate portion; and said interlock device is formed by at least one permanent magnet.

13. The plate support arrangement according to claim 12, wherein:

said bottom plate portion comprises an outer edge portion disposed about the periphery of said bottom plate portion;

said bottom plate portion comprises a plurality of recesses disposed about the periphery of said outer edge portion;

said plurality of tab-like extensions are configured and disposed to matingly engage with said plurality of recesses of said bottom plate portion, and to substantially prevent separation of said top plate portion from said bottom plate portion; and said plurality of tab-like extensions are configured and disposed to matingly engage with said plurality of recesses of said bottom plate portion to substantially restrict or limit rotation of said top plate portion with respect to said bottom plate portion.

14. The plate support arrangement according to claim 13, wherein said tab-like extensions are disposed spaced apart from one another about the periphery of said top plate portion.

15. The plate support arrangement according to claim 14, wherein each of said recesses of said bottom plate portion is configured to extend substantially less than 360 degrees over a portion of the periphery of said outer edge portion.

16. The plate support arrangement according to claim 15, wherein at least two permanent magnets are distributed around the plate support arrangement center axis, and are provided at some radial distance from said center axis.

17. The plate support arrangement according to claim 16, wherein said top plate portion is realized in the form of a centering element for bottles or similar containers with a centering surface that covers said friction lining at least in partial areas.

18. The plate support arrangement according to claim 17, wherein said top plate portion comprises a top plate element and a bottom plate element located one on top of the other and detachably connected to another.

19. The plate support arrangement according to claim 18, wherein said tab-like extensions form a handle for the removal of said top plate portion.

20. The plate support arrangement according to claim 12, wherein said plate support arrangement comprises a top plate portion replacement kit comprising a plurality of top plate portions being configured to be detachably connected to said bottom plate portion.

* * * * *